US006244914B1

(12) United States Patent
Freitag et al.

(10) Patent No.: US 6,244,914 B1
(45) Date of Patent: Jun. 12, 2001

(54) SHIFT AND STEERING CONTROL SYSTEM FOR WATER JET APPARATUS

(75) Inventors: Michael W. Freitag; Paul E. Westhoff, both of Kenosha; Richard M. McChesney, Waukegan; James R. Jones, Neosho, all of WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/472,714

(22) Filed: Dec. 24, 1999

(51) Int. Cl.[7] ..... B63H 11/107
(52) U.S. Cl. ..... 440/40; 440/42; 440/82
(58) Field of Search ..... 440/40, 41, 42, 440/43, 38; 60/221, 222

(56) References Cited

U.S. PATENT DOCUMENTS

| | | | | |
|---|---|---|---|---|
| 2,993,463 | * | 7/1961 | McKinney | 440/41 |
| 3,105,353 | * | 10/1963 | Schulz | 440/41 |
| 3,422,789 | * | 1/1969 | Wynne et al. | 440/43 |
| 3,641,964 | * | 2/1972 | Lee | 440/42 |
| 3,782,114 | * | 1/1974 | Broes | 60/221 |
| 3,795,105 | * | 3/1974 | Aschauer | 60/221 |
| 3,807,346 | * | 4/1974 | Delfeld | 440/41 |
| 3,834,342 | * | 9/1974 | Schoell | 440/41 |
| 3,842,787 | * | 10/1974 | Giacosa | 440/41 |
| 3,906,885 | * | 9/1975 | Woodfill | 440/42 |
| 3,942,464 | * | 3/1976 | Schoell | 440/41 |
| 4,031,844 | * | 6/1977 | Onai et al. | 440/41 |
| 4,231,315 | * | 11/1980 | Tachibana et al. | 440/43 |
| 4,652,244 | * | 3/1987 | Drury | 440/40 |
| 4,813,895 | * | 3/1989 | Takahashi | 440/41 |
| 5,421,753 | * | 6/1995 | Roos | 440/43 |
| 5,752,964 | | 5/1998 | Jones et al. | 440/41 |

* cited by examiner

*Primary Examiner*—S. Joseph Morano
*Assistant Examiner*—Ajay Vasudeva
(74) *Attorney, Agent, or Firm*—Dennis M. Flaherty

(57) ABSTRACT

A water jet apparatus mounted to a horizontal hull section and having a shift and steering control assembly which penetrates a hole in that hull section. The shift and steering control assembly has a modular lever and shaft subassembly which is installed in the inlet housing, before the inlet housing is installed in the hull. The modular lever and shaft assembly includes a shift and steering control housing mounted to the inlet housing and having respective bores for housing shift and steering shafts. Upper shift and steering levers are coupled to the upper ends of the shift and steering shafts respectively, while lower shift and steering levers are coupled to the lower ends of the shift and steering shafts respectively. Respective control cables are attached to the upper levers inside the hull; respective control rods for operating a steering nozzle and a reverse gate are attached to the lower levers outside the hull.

29 Claims, 8 Drawing Sheets

1/8

SHIFT AND STEERING CONTROL SYSTEM FOR WATER JET APPARATUS

FIELD OF THE INVENTION

This invention generally relates to water jet apparatus for propelling boats and other watercraft. In particular, the invention relates to mechanisms for steering and/or shifting a water jet apparatus.

BACKGROUND OF THE INVENTION

It is known to propel a boat or other watercraft using a water jet apparatus mounted to the hull, with the powerhead being placed inside (inboard) the hull. The drive shaft of the water jet apparatus is coupled to the output shaft of the inboard motor. The impeller is mounted on the drive shaft and housed in a jet propulsion pipe or water tunnel.

To facilitate use of water jet-propelled boats in shallow water, it is known to mount the water jet at an elevation such that the water jet does not project below the bottom of the boat hull. This can be accomplished, for example, by installing a duct in the stern of the boat, the duct being arranged to connect one or more inlet holes formed in the bottom of the hull with an outlet hole formed in the transom. The water jet is then installed outside the hull in a position such that the water jet inlet is in flow communication with the duct outlet at the transom. Such a system is shown in Australian Patent Specification No. 262306, published in 1963. Alternatively, the water jet can be installed inside the duct built into the hull, as shown in U.S. Pat. No. 5,181,868.

In another type of design, a water jet apparatus is installed inside the hull and penetrates the transom. An inlet housing of the water jet has a horizontal opening and an inclined water tunnel for guiding water to the impeller. The horizontal opening of the inlet housing is mounted in a hole in the bottom or near the bottom of the hull. A similar design is disclosed in Swiss Patent No. 481788.

The prior art cited above does not disclose means for passing through the hull the control system for shifting and steering the reverse gate and the steering nozzle respectively of a water jet apparatus mounted to the hull. In particular, there is a need for a design which would allow the shift and steering control system to penetrate a horizontal section of the hull.

SUMMARY OF THE INVENTION

The present invention is a shift and steering control assembly for activating the steering nozzle and reverse gate of a water jet apparatus. The water jet apparatus comprises an inlet housing which is mounted outside the hull in a cavity. The control cables are located inside the hull and activate the steering nozzle and reverse gate by means of levers and links. The shift and steering control assembly is designed for easy assembly. In particular, the shift and steering control assembly comprises a modular lever and shaft assembly which can be installed in the inlet housing, before the inlet housing is installed in the hull. When the inlet housing is installed, the modular lever and shaft assembly penetrates the hull. To facilitate passage of the upper portion of the lever and shaft assembly through an opening in the hull, one of the upper levers is not attached to the assembly until after the inlet housing is attached to the hull. Then the shift and steering cables are connected to upper shift and steering levers respectively. In the final assembled state, the shift and steering cables and upper shift and steering levers are inside the hull, while the lower shift and steering levers and the shift and steering rods reside outside the hull.

In accordance with the preferred embodiment of the invention, the modular lever and shaft assembly comprises a shift and steering control housing which is mounted to the inlet housing. The shift and steering control housing has respective bores for housing shift and steering shafts. Upper shift and steering levers are coupled to the upper ends of the shift and steering shafts respectively, while lower shift and steering levers are coupled to the lower ends of the shift and steering shafts respectively, thus forming rigid structures which are rotatably supported by the shift and steering control housing. In response to operation of one of the cables, the corresponding rigid lever and shaft assembly is rotated, causing the respective lower lever to swing, thereby displacing the corresponding control rod. The steering nozzle is activated in response to operation of the steering cable, while the reverse gate is activated in response to operation of the shift cable.

BRIEF DESCRIPTION THE DRAWINGS

DETAILED DESCRIPTION OF THE PREFERRED EMBODIMENTS

Figures 1, 1A:
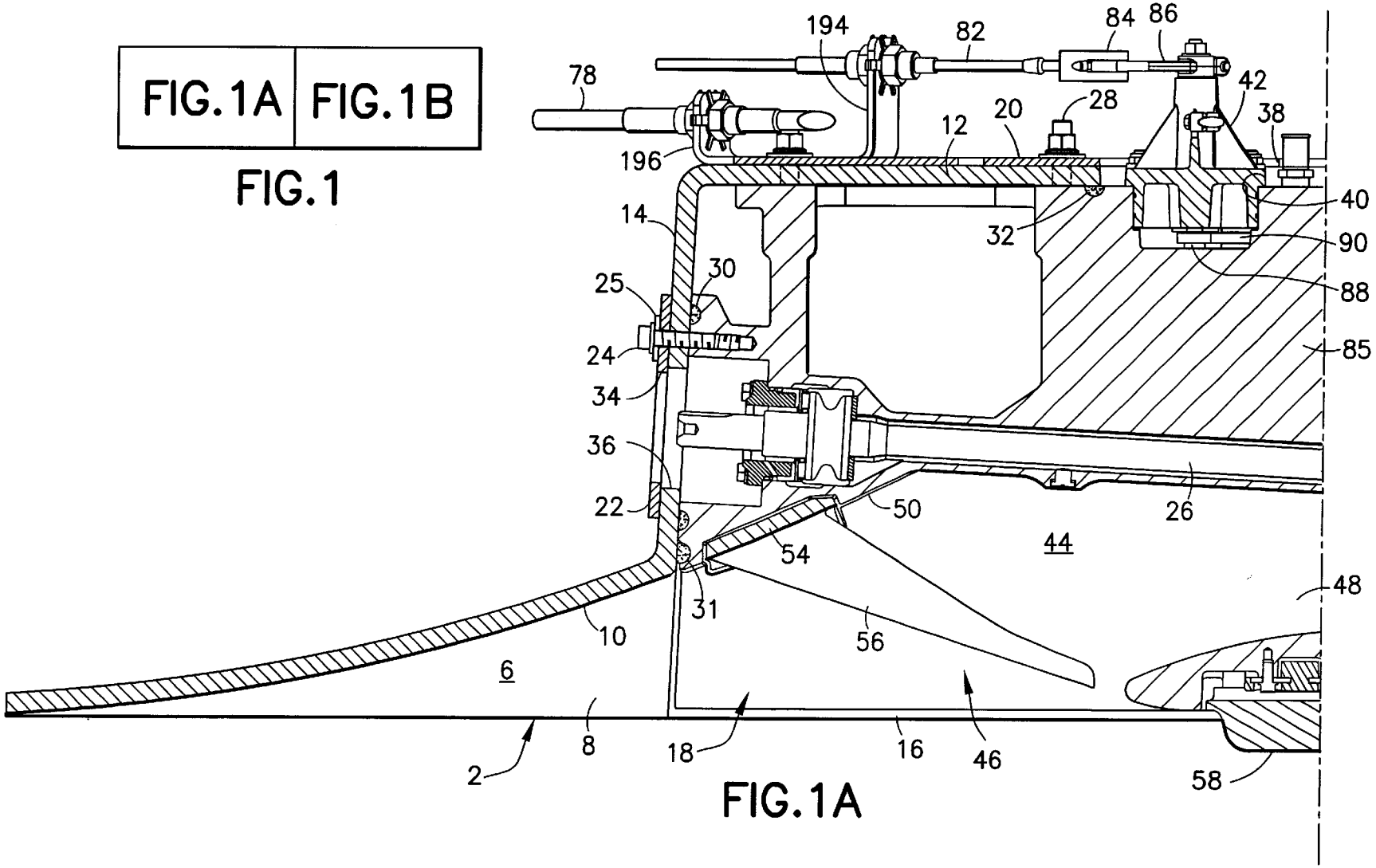
FIG. 1 is a schematic (presented in two sheets respectively labeled FIGS. 1A and 1B) showing a sectional view of a water jet apparatus mounted to a boat hull in accordance with a preferred embodiment of the invention, the section being taken along a vertical midplane.
Figure 1B:
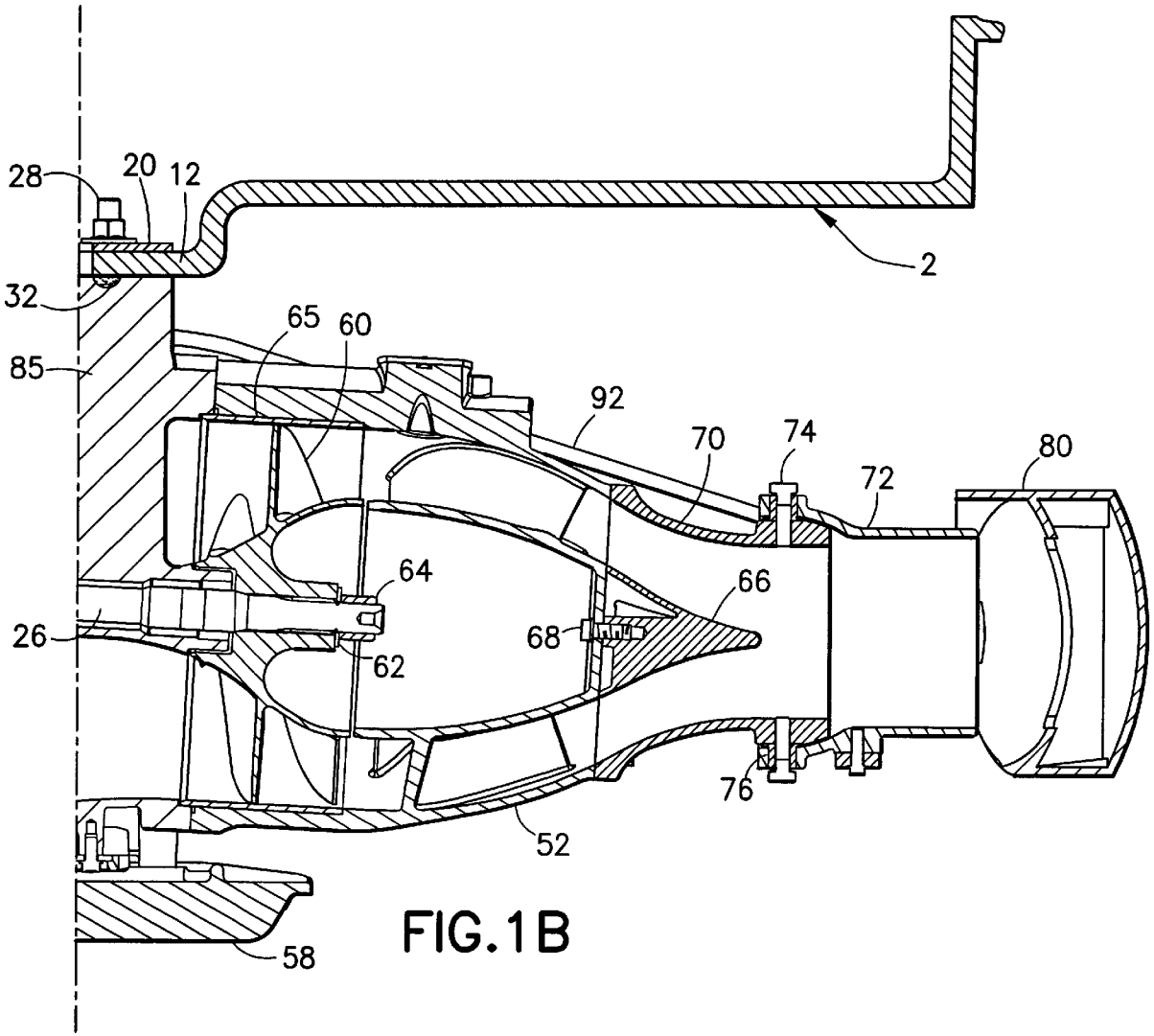

As seen in FIG. 1, the water jet apparatus incorporating the invention is designed to be installed in a cavity under a section of the hull and in flow communication with the outlet of an inlet ramp built into the hull. As seen in FIG. 1, the boat hull 2 has an inlet ramp 6 formed by a pair of opposing sidewalls 8 and a guide surface 10 which curves gently upward in the aft direction. The end of the inlet ramp 6 is in flow communication with a cavity in which the water jet apparatus is installed. This cavity for the water jet apparatus is defined by a horizontal hull section 12, a vertical hull section 14 and a pair of opposing sidewalls 16 (only one of which is visible in FIG. 1), the cavity being open at the bottom and rear for allowing insertion of the water jet apparatus.

The water jet apparatus comprises an inlet housing which is slid into the aforementioned cavity and bolted to the hull by means of a top mounting plate 20 and a front plate 22. At the time of inlet housing installation, the drive shaft 26 is already rotatably mounted in the inlet housing. In particular, the inlet housing 18 comprises a vertical strut 85 having an axial bore which houses a portion of the drive shaft. During inlet housing installation, the front plate 22 is placed on the inside of the vertical hull section 14 and the inlet housing 18 is placed on the outside of vertical hull section 14, a set of three throughholes in the vertical hull section 14 and a set of three threaded holes in the inlet housing 18 being aligned with a set of three throughholes in the vertical hull section 14. Three screws 24 (only one of which is visible in FIG. 1) are passed through the aligned throughholes and screwed into the threaded holes of the inlet housing 18. The numeral 25 in FIG. 1 denotes a washer placed between the head of screw 24 and the front plate 22. The front plate 22 has an opening 34 (best seen in FIG. 2) which, in the assembled state, is aligned with an opening 36 in the vertical hull section 14 to allow the output shaft (not shown) from the inboard motor to be coupled to the front end of the drive shaft 26. The studs 28 are affixed to the inlet housing 18. The inlet housing 18 is inserted into the hull cavity and the studs 28 are inserted into throughholes in the hull. The front plate 22 is then positioned and screws 24 are screwed into the inlet housing 18. The top mounting plate 20 is then placed over the studs 28 and secured to the hull using nuts and washers.

In the assembled position, a front portion of the inlet housing 18 is sealed against the vertical hull section 14 by means of a seal 30 and a top portion of the inlet housing 18 is sealed against the horizontal hull section 12 by means of a seal 32. The seal 30 encompasses the interface where the openings in the vertical hull section 14 and inlet housing for the drive shaft 26 meet and is designed to prevent water leaking into the drive shaft assembly or into the boat via the opening 36. Similarly, the top mounting plate 20 has an opening 38 which, in the assembled state, is aligned with an opening 40 in the horizontal hull section 12 to allow a shift and steering control housing 42 to be placed in a corresponding opening in the top wall of the inlet housing 18. The seal 32 encompasses the interface where the openings in the horizontal hull section 12 and inlet housing for the shift and steering housing 42 meet and is designed to prevent water leaking into the boat via the opening 38. In addition, a seal 31 is pressed between the inlet housing 18 and the hull along the front and sides of the inlet housing.

The inlet housing 18 has a water tunnel 44 with an inlet 46. The water tunnel 44 has a pair of sidewalls 48 (only one of which is shown in FIG. 1) which are generally coplanar with the sidewalls 8 of the hull inlet ramp 6. In addition, the water tunnel 44 has a guide surface 50 which starts at a point near where the guide surface 10 of the hull inlet ramp 6 ends and then curves gradually upward in the aft direction. As a result of the foregoing structure, there is a generally smooth transition between the end of inlet ramp 6 and the beginning of water tunnel 44. Thus the hull 2 and the inlet housing 18 combine to form a single inlet for guiding water toward the inlet of a stator housing 52 located downstream of the inlet housing.

An inlet grate 54 extends across the inlet 46 of the water tunnel 44 and serves to block the admission of debris into the water jet apparatus. The inlet grate 54 comprises a multiplicity of generally parallel tines 56 which extend downward and rearward from an upper end of the inlet grate. Only the upper end of the inlet grate is attached to the inlet housing by screws (not shown). The cantilevered design is based on the theory that any weeds that wrap around the grate will be drawn down to the lower, open end and slide of f under the boat and/or be drawn into the pump and chopped up. In addition, a ride plate 58 is attached to the bottom of the inlet housing 18.

Figure 3:
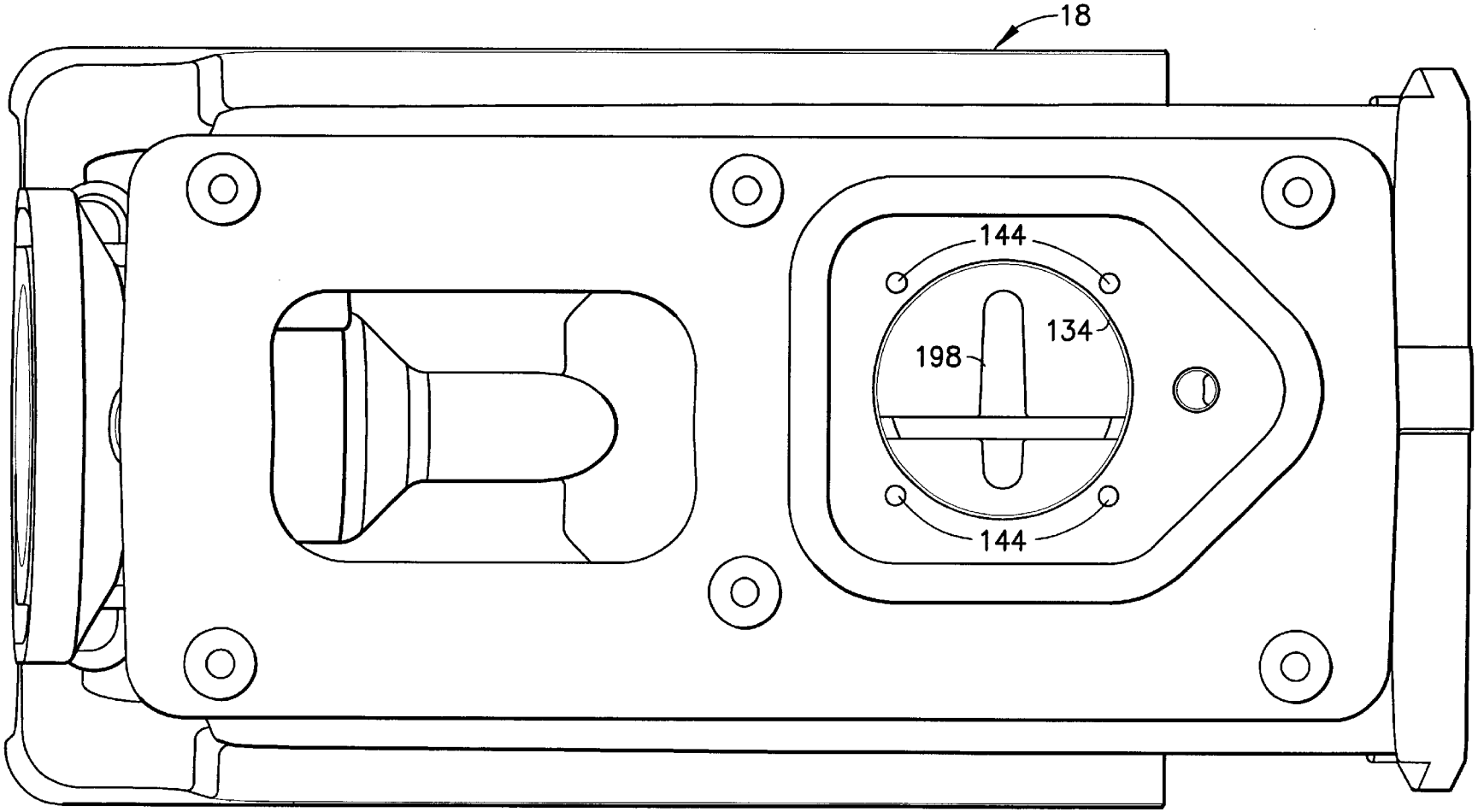
FIG. 3 is a schematic showing a top view of the inlet housing in accordance with the preferred embodiment of the invention.

As shown in FIG. 1, the drive shaft projects in the aft direction out of the inlet housing 18. The impeller is pre-assembled in the unit prior to mounting in the hull. The hub and blades of impeller 60 are integrally formed as one cast piece. The hub of impeller 60 has a splined bore which meshes with splines formed on the external surface of the drive shaft 26, so that the impeller 60 will rotate in unison with the drive shaft 26. Also, a taper on the impeller locks on to a taper on the drive shaft to hold the impeller in place (see FIG. 3). The impeller 60 is held securely on the drive shaft 26 by a washer 62, which in turn is held in place by a lock nut 64 tightened onto a threaded end of the drive shaft 26. As seen in FIG. 1, the hub of the impeller 60 increases in radius in the aft direction, transitioning gradually from a generally conical outer surface at the leading edge of the impeller hub to a generally circular cylindrical outer surface at the trailing edge of the impeller hub. This outer surface of the impeller hub forms the radially inner boundary for guiding the flow of water impelled by the impeller.

The stator housing 52 comprises inner and outer shells connected by a plurality of stator vanes, all integrally formed as a single cast piece. The hub of the stator housing 52 gradually decreases in radius in the aft direction, starting out at a radius slightly less than the radius at the trailing edge of the impeller hub. The stator vanes are designed to redirect the swirling flow out of the impeller 60 into non-swirling flow. The stator housing hub has a radial end face with a central throughhole. Before the stator housing is installed, a tail cone cover 66 is attached to the radial end face of the stator housing hub by a screw 68. The front of the stator housing 52 is then attached to the rear of the inlet housing 18 by a plurality of screws (not shown in FIG. 1).

A circumferential recess in the stator housing 52 at a position opposing the impeller blade tips has a circular cylindrical wear ring 65 seated therein. Wear to the impeller blade tips is mainly due to the pumping of abrasives such as beach sand. The purpose of the wear ring 65 is to protect the soft aluminum casting with a hard stainless steel surface, thus drastically reducing the rate of wear.

After the stator housing 52 (with attached tail cone cover 66) has been attached to the inlet housing 18, the front of an exit nozzle 70 is attached to the rear of the stator housing 52 by screws. The front faces of the tail cone cover 66 and the exit nozzle 70 are preferably coplanar. The water flowing out of the stator housing 52 will flow through the space between the tail cone cover 66 and the exit nozzle 70, and then will exit the exit nozzle at its outlet.

Figure 2A:
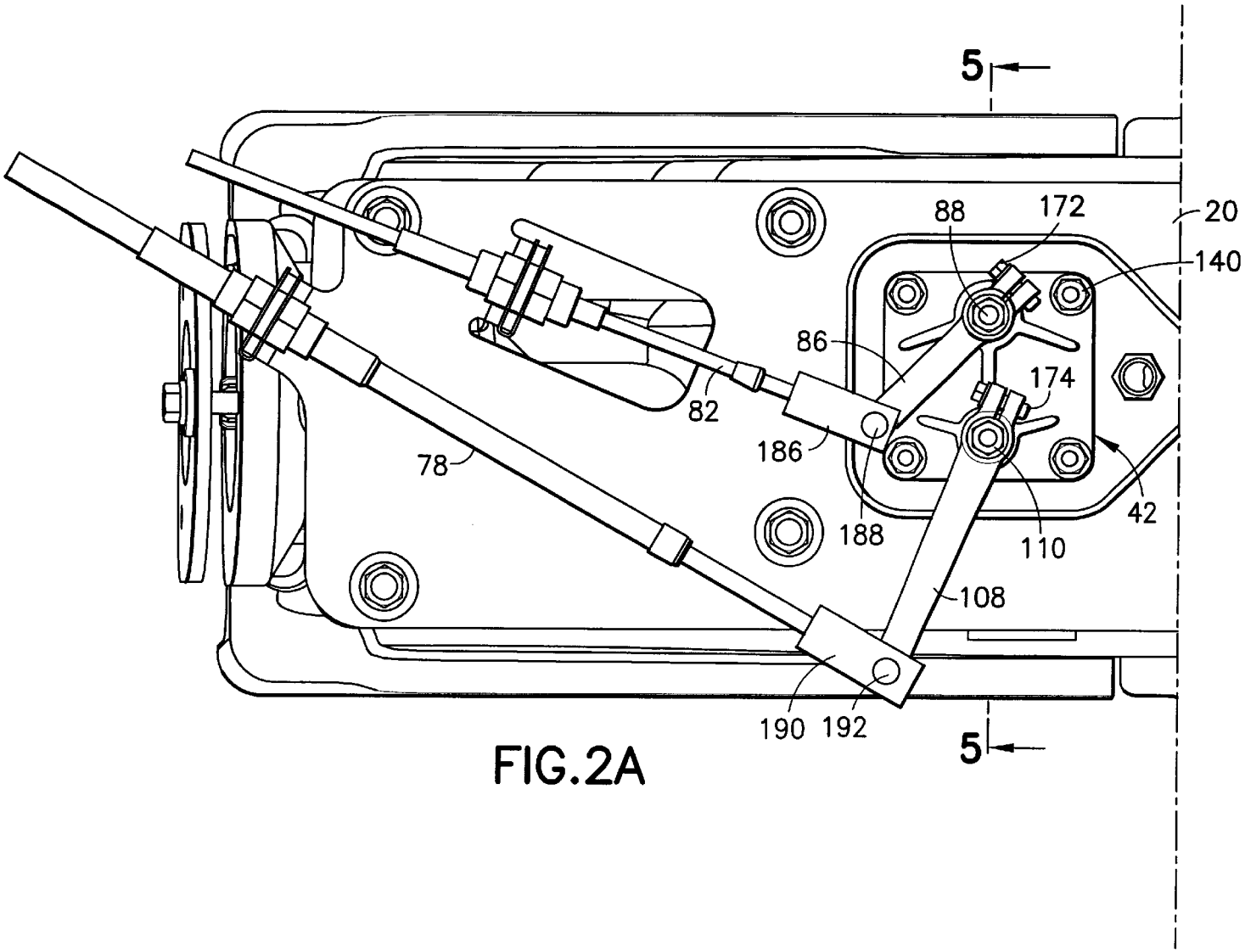
FIG. 2 is a schematic (presented in two sheets respectively labeled FIGS. 2A and 2B) showing a top view of the top mounting plate and the water jet apparatus depicted in FIG. 1, with the hull removed.
Figure 2B:
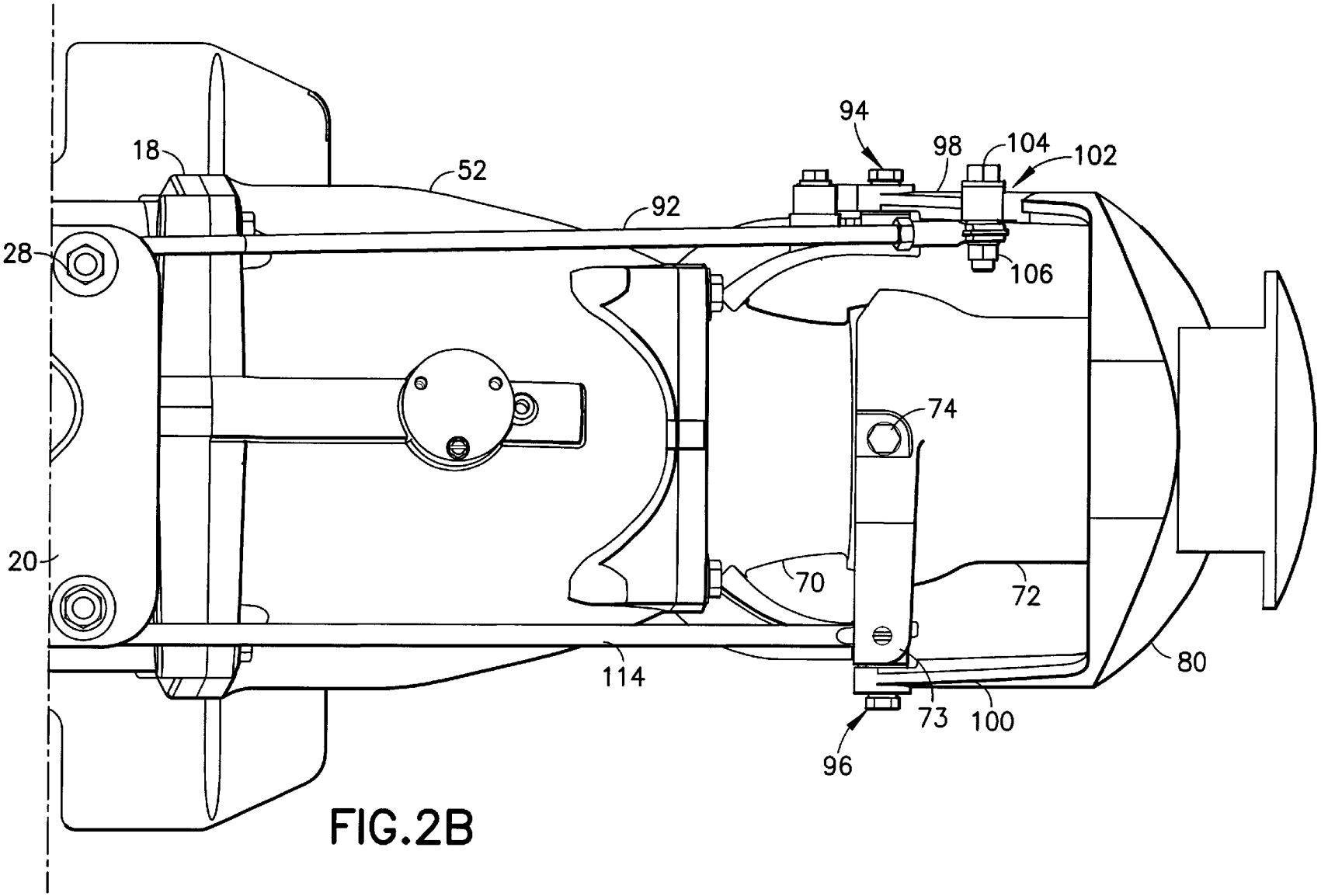

The water jet apparatus shown in FIG. 1 is provided with a steering nozzle 72 which can change the direction of the water exiting the exit nozzle 70. This effect is used by the boat operator to steer the boat left or right. To accomplish this, the steering nozzle 72 is pivotably mounted to the exit nozzle 70 by a pair of pivot assemblies located at the top and bottom of the exit nozzle. Each pivot assembly comprises a screw 74, a sleeve (not visible in FIG. 1) and a bushing 76. The axes of the screws 74 are collinear and form a vertical pivot axis about which the steering nozzle 72 can rotate. In particular, the steering nozzle has a pair of circular holes in which the bushings 76 are seated. The sleeves are inserted inside the respective bushings 76. The screws 74 are in turn inserted in the sleeves and screwed into respective threaded holes in the exit nozzle 70. As best seen in FIG. 2B, the steering nozzle 72 has an arm 73 which is pivotably coupled to a flattened end of a steering rod 114. Displacement of the steering rod 114 in response to operation of a steering cable 78 (see FIG. 2A) causes the steering nozzle to swing a desired direction about its vertical pivot axis.

The water jet apparatus shown in FIG. 1 is also provided with a non-steerable reverse gate 80 which is pivotable between forward and reverse positions. In the forward position, the reverse gate 80 is raised, thereby allowing water to exit the steering nozzle 72 freely. In the reverse position, the reverse gate 80 is lowered to a position directly opposite to the outlet of the steering nozzle 72. The reverse gate is designed to partially reverse the flow of water exiting the steering nozzle 72 when the reverse gate is in the reverse position. This reverse flow of water will urge the boat in the aft direction. To accomplish the foregoing, the reverse gate 80 is pivotably mounted to the exit nozzle 70 by a pair of pivot assemblies 94 and 96 located on opposite sides of the exit nozzle (see FIG. 2B). Each pivot assembly 94 and 96 has a construction substantially identical to the pivot assemblies previously described with reference to pivoting of the steering nozzle 72. As seen in FIG. 2B, the reverse gate has a pair of arms 98 and 100, the ends of which are pivotably coupled to the respective pivot assemblies 94, 96. The reverse gate 80 is pivoted by a shift rod 92, the end of which is coupled to arm 98 of the reverse gate 80 by means of a rod end assembly 102 which comprises a ball socket for allowing horizontal radial motion at the shift lever and vertical radial motion at the reverse gate. The rod end assembly is attached to arm 98 by means of a screw 104 and a lock nut 106. Displacement of the shift rod 92 in response to operation of a shift cable 82 (see FIG. 2A) causes the reverse gate to swing in a desired direction, namely, into forward position or reverse position. The reverse gate has a design which allows the boat to steer in reverse in the same direction like an outboard, stern drive or car.

Figure 4:
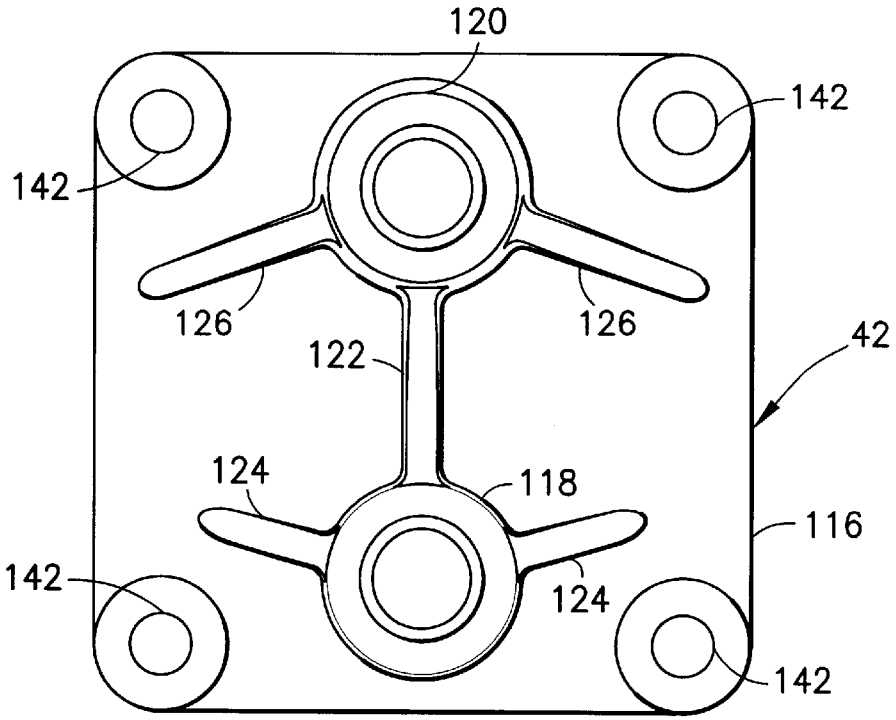
FIGS. 4, 6 and 7 are schematics showing top, side and bottom views of the shift and steering control housing in accordance with the preferred embodiment of the invention.
Figure 6:
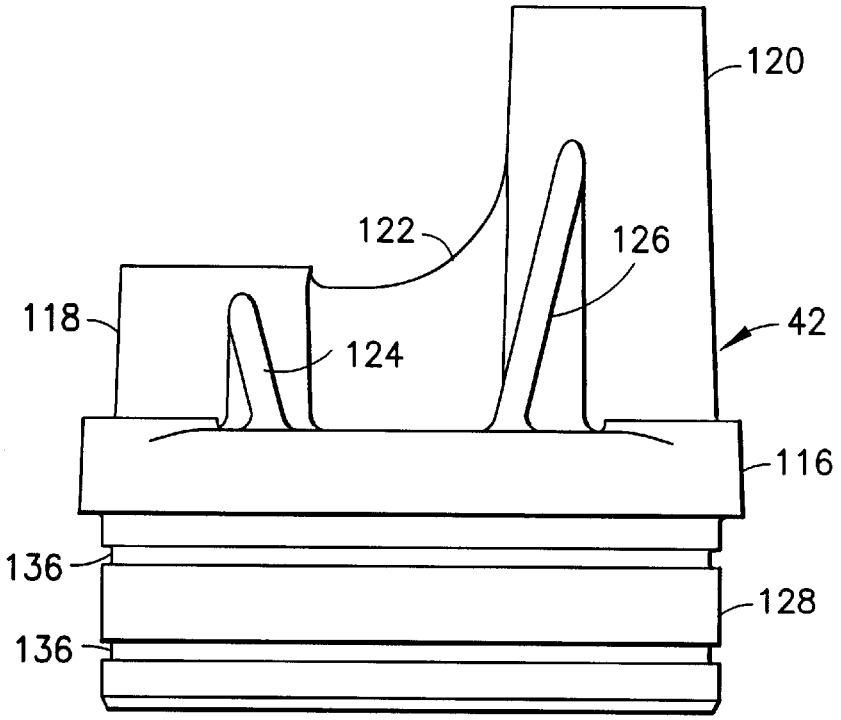
Figure 5:
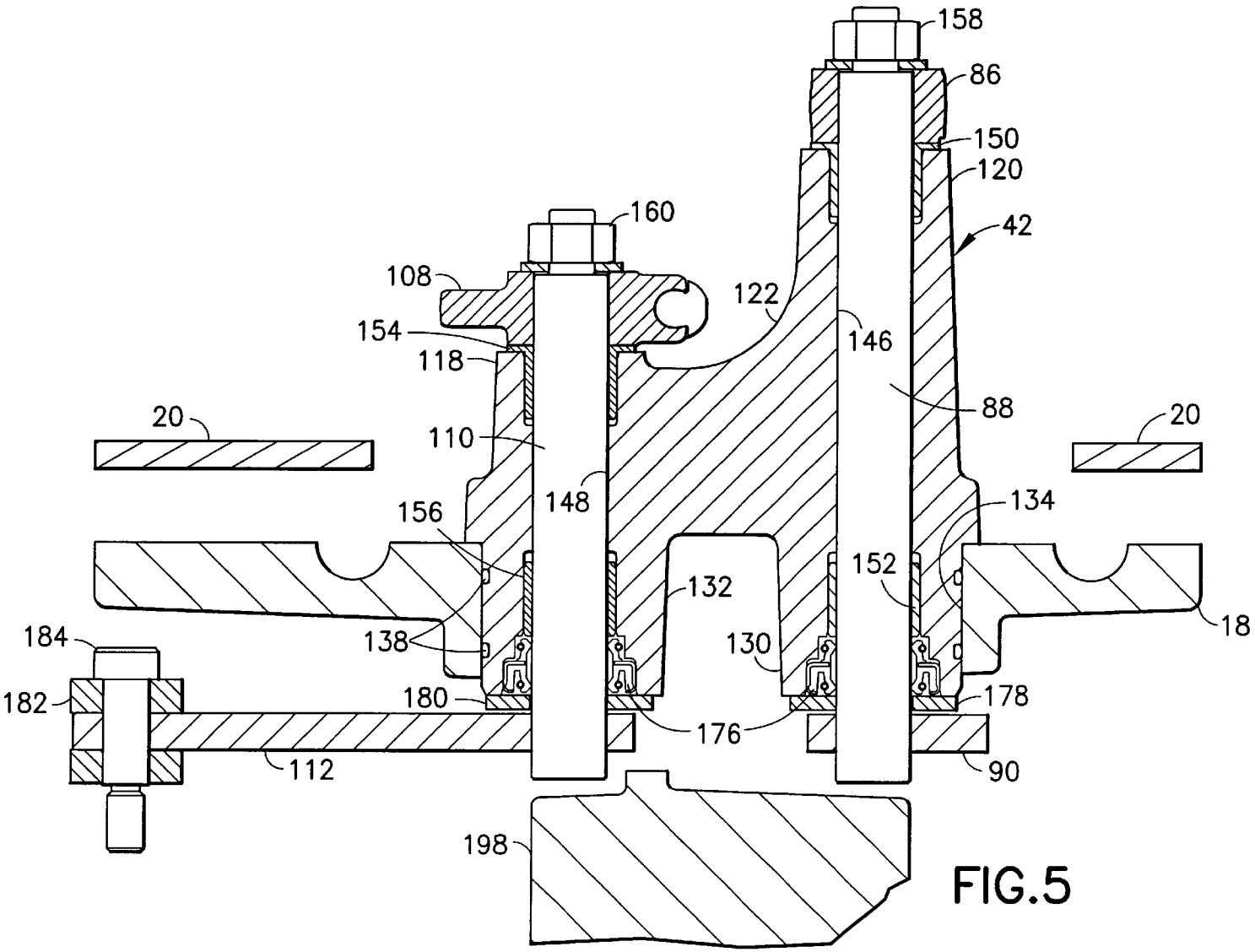
FIG. 5 is a schematic showing a sectional view taken along line 5—5 shown in FIG. 2A.
Figure 7:
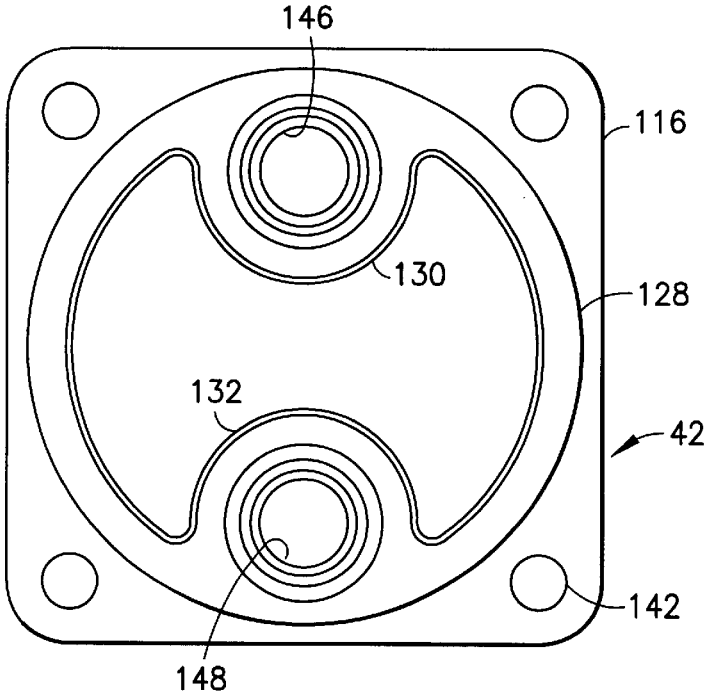

In accordance with the preferred embodiment of the invention, the shift and steering cables located inside the hull are respectively coupled to the shift and steering rods located outside the hull by means of respective lever and shaft assemblies rotatably supported in a shift and steering control housing 42 which is installed in a corresponding opening in the top of the inlet housing 18. As best seen in FIGS. 4 and 5, the housing 42 preferably comprises a base plate 116, an upper vertical tubular structure 118 integrally formed with base plate 116 and extending above it to a first height, and an upper vertical tubular structure 120 integrally formed with base plate 116 and extending above it to a second height greater than the first height. As seen in FIG. 5, the tubular structures 118 and 120 are reinforced by a rib 122 extending therebetween and integrally formed therewith and with the base plate 116. Additional reinforcement is provided by respective pairs of ribs 124 and 126 (see FIG. 4). As seen in FIG. 4, the base of housing 42 has a generally square shape with rounded corners. Below the base plate, the housing has a circular cylindrical lower wall 128 (shown in FIG. 7), integrally formed with lower vertical tubular structures 130 and 132. The lower wall 128 slides into a circular opening 134 (shown in FIG. 3) formed in the top wall of the inlet housing 18. The opening 134 in the inlet housing communicates with the exterior of the water jet apparatus via a pair of opposing side channels through which the lower shift and steering levers (described below) respectively pass. The lower wall 128 is provided with a pair of annular grooves 136 (see FIG. 6) in which respective O-rings 138 (see FIG. 5) are installed to seal the interface of the respective housings 18 and 42 against leakage of water through opening 134 and into the hull.

Preferably the opening 40 (see FIG. 1A) in the horizontal hull section 12 closely matches the opening in mounting plate. As seen in FIG. 2A, the housing 42 is bolted to the inlet housing 18 by studs 140. The shift and steering control housing 42 has throughholes 142 at respective corners (see FIGS. 4 and 7). The studs 140 are threaded into respective threaded holes 144 formed in the top wall of the inlet housing 18 (see FIG. 3).

As seen in FIG. 5, the shift and steering control housing 42 has one bore 146 for receiving the shift shaft 88 and another bore 148 for receiving the steering shaft 110. The bore 146 has upper and lower annular recesses in which upper and lower bushings 150 and 152 are respectively inserted; the bore 148 has upper and lower annular recesses in which upper and lower bushings 154 and 156 are respectively inserted. The shift shaft 88 is rotatably supported in bushings 150 and 152, while steering shaft 110 is rotatably supported in bushings 154 and 156. One end of the upper shift lever 86 is secured to the top of the shift shaft 88 by means of a lock nut 158 which screws onto a threaded end of the shift shaft; one end of the upper steering lever 108 is secured to the top of the steering shaft 110 by means of a lock nut 160 which screws onto a threaded end of the steering shaft. (only a portion of each of the upper levers is shown in FIG. 5.) The upper levers bear on the flanges of the upper bushings during rotation of the lever and shaft assemblies.

Figure 8:
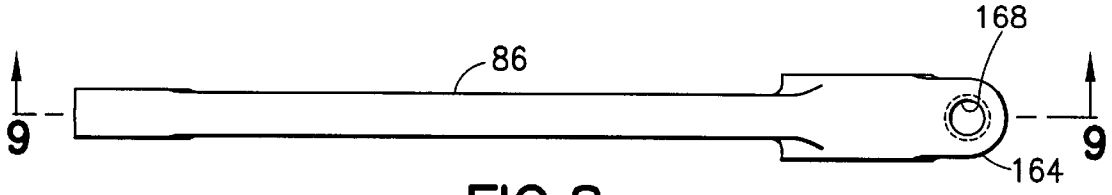
FIG. 8 is a schematic showing a side view of the upper steering lever in accordance with the preferred embodiment of the invention.
Figure 9:
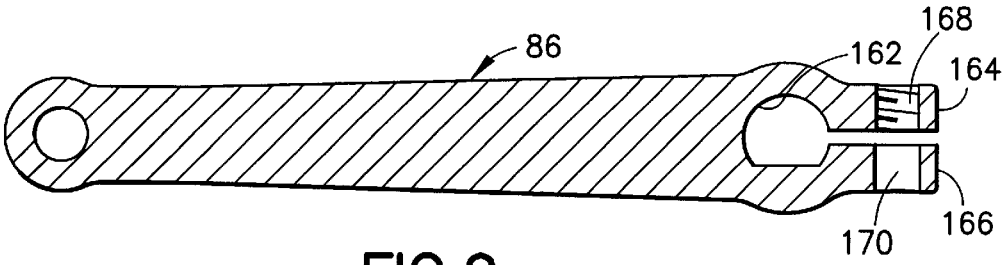
FIG. 9 is a schematic showing a sectional view of the upper steering lever, the section being taken along line 9—9 shown in FIG. 8.

As shown in FIG. 9, the upper shift lever 86 has a D-slot 162 which form fits on a portion of the shift shaft having a D-shaped cross section. As seen in FIG. 8, the upper shift lever 86 has a pair of opposing fingers 164 and 166, the former having a threaded hole 168 and the latter having a throughhole 170. These fingers are pinched together by a screw 172, best seen in FIG. 2A, the resulting compressive force clamping the upper shift lever to the shift shaft. The upper steering lever 108 has a similar construction, with fingers pinched together by a screw 174 to clamp the upper steering lever to the steering shaft. Alternatively, the shift and steering levers can be stampings retained by washers and nuts, with the "pinch" fingers being eliminated. The reference numeral 176 designates a pair of seals installed in annular recesses formed at the bottom of the respective lower vertical tubular structures 130 and 132, in surrounding relationship with the shift and steering shafts respectively.

Still referring to FIG. 5, a lower shift lever 90 is welded to the bottom of the shift shaft 88, while a lower steering lever 112 is welded to the bottom of the steering shaft 110. A lower washer 178 is installed between the lower shift lever 90 and the lower vertical tubular structure 130 of the shift and steering control housing 42, while a lower washer 180 is installed between the lower steering lever 112 and the lower vertical tubular structure 132 of housing 42. The washers 178 and 180 provide a bearing surface.

The full length of the lower steering lever 112 is shown in FIG. 5, while only a portion of the lower shift lever 90 is depicted. FIG. 5 shows a clevis 182 and a shoulder screw 184 for attaching the distal end of the lower steering lever 112 to the forward end of the steering rod (not shown in FIG. 5). Similarly, the distal end of the lower shift lever is attached to the forward end of the shift rod by means of a clevis and shoulder screw coupling (not shown in FIG. 5).

Referring to FIG. 2A, the distal end of the upper shift lever 86 is attached to the shift cable 82 by means of a clevis 186 and a clevis pin 188. These components are located inside the hull of the boat (see FIG. 1A). Displacement of the end of the shift cable causes the shift lever and shaft assembly to rotate. Likewise the distal end of the upper steering lever 108 is attached to the steering cable 78 by means of a clevis 190 and a clevis pin 192, and displacement of the end of the steering cable causes the steering lever and shaft assembly to rotate. As best seen in FIG. 1A, the shift cable 82 is supported by a bracket 194 and the steering cable 78 is supported by a bracket 196, both brackets being integrally connected to and extending vertically upward from the top mounting plate 20. In response to operation of the steering cable 78, the steering nozzle can be selectively turned left or right to steer the boat as desired during water jet operation. In response to operation of the shift cable 82, the reverse gate can be selectively raised or lowered to propel the boat forward or rearward as desired during water jet operation.

The foregoing structure is designed to facilitate installation of a shift and steering control system which penetrates a horizontal hull section of a boat. The assembly procedure is as follows. The lower levers are welded to the bottom ends of the respective shift and steering shafts. These welded lever and shaft subassemblies are then inserted in a large opening in the inlet housing, the bottoms of the shafts being supported by a boss 198 (seen in FIG. 5). As part of the assembly, grease is applied to both shafts. Then a pair of O-rings are installed in the annular grooves of the shift and steering control housing 42. One of the shaft is then placed in position in the opening in the inlet housing and the corresponding bore (146 or 148) of the shift and steering control housing 42 is slid over the top part of that shaft. Then the second shaft is passed up through the inlet housing and its top section is slid into the other bore, following which the housing 42 is slid downward and into the receiving opening in the inlet housing 18. In the final position, the housing 42 is bolted to the inlet housing 18. Then the upper shift lever 86 is assembled to the shift shaft 88. The upper steering lever is not pre-assembled to its shaft to allow assembly of the inlet housing to the hull. Therefore, means are provided for retaining the steering shaft and lower steering lever subassembly in the housing 42, either temporarily or permanently, until the upper steering lever is installed in the boat. After the inlet housing has been attached to the hull via the front plate and top mounting plate, the upper steering lever is attached to the top of the steering shaft. Then the shift and steering cables are respectively connected to the upper shift and steering levers.

Preferably the inlet housing and the shift and steering control housing are made of sand-cast aluminum or molded plastic, while the stator housing is preferably made of stainless steel.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "outlet housing" comprises one or more attached parts. For example, in the disclosed preferred embodiment, the stator housing and the exit nozzle form an outlet housing. However, the present invention encompasses forming the stator housing and the exit nozzle as one piece, or forming the stator housing as two pieces, and so forth.

What is claimed is:

1. A water jet apparatus comprising:

an inlet housing comprising a water tunnel having an outlet and a cavity having an opening;

an outlet housing comprising a water tunnel having an inlet in flow communication with said outlet of said water tunnel of said inlet housing;

a steering nozzle pivotably mounted to said outlet housing;

a steering assembly for pivoting said steering nozzle, said, steering assembly comprising a steering shaft and a lower steering subassembly for coupling pivoting of said steering nozzle to rotation of said steering shaft; and a control housing installed in said cavity of said inlet housing and comprising a first bore, said steering shaft being rotatably mounted in said first bore.

2. The water jet apparatus as recited in claim 1, wherein said lower steering subassembly comprises a lower steering lever rigidly connected to a lower end of said steering shaft.

3. The water jet apparatus as recited in claim 2, wherein said lower steering subassembly further comprises a steering rod arranged to couple said steering nozzle to said lower steering lever.

4. The water jet apparatus as recited in claim 2, wherein said steering assembly further comprises an upper steering lever rigidly connected to an upper end of said steering shaft.

5. The water jet apparatus as recited in claim 1, further comprising:

a pivotably mounted reverse gate; and a shift assembly for pivoting said reverse gate, said shift assembly comprising a shift shaft and a lower shift subassembly for coupling pivoting of said reverse gate to rotation of said shift shaft, wherein said control housing comprises a second bore, said shift shaft being rotatably mounted in said second bore.

6. The water jet apparatus as recited in claim 5, wherein said lower shift subassembly comprises a lower, shift lever rigidly connected to a lower end of said shift shaft.

7. The water jet apparatus as recited in claim 6, wherein said lower shift subassembly further comprises a shift rod arranged to couple said reverse gate to said lower shift lever.

8. The water jet apparatus as recited in claim 6, wherein said shift assembly further comprises an upper shift lever rigidly connected to an upper end of said shift shaft.

9. The water jet apparatus as recited in claim 5, wherein said shift and steering shafts have different lengths.

10. The water jet apparatus as recited in claim 1, wherein said control housing comprises a circular cylindrical outer surface having an annular groove formed therein.

11. A water jet apparatus comprising:

an inlet housing comprising a water tunnel having an outlet and a cavity having an opening;

an outlet housing comprising a water tunnel having an inlet in flow communication with said outlet of said water tunnel of said inlet housing;

a pivotably mounted reverse gate;

a shift assembly for pivoting said reverse gate, said shift assembly comprising a shift shaft and a lower shift subassembly for coupling pivoting of said reverse gate to rotation of said shift shaft; and a control housing installed in said cavity of said inlet housing and comprising a bore in which said shift shaft is rotatably mounted.

12. A housing system for a water jet apparatus comprising:

an inlet housing designed to house at least a portion of a drive shaft and having an inlet for water;

a stator housing designed to house at least a portion of an impeller, said stator housing being attached to said inlet housing; and a control housing designed to house a first shaft, said control housing being attached to said inlet housings, wherein said inlet housing comprises a cavity having an opening, said control housing being seated in said cavity.

13. The housing system as recited in claim 12, wherein said control housing is further designed to house a second shaft.

14. The housing system as recited in claim 13, further comprising a seal arranged in said cavity between said control housing and said inlet housing.

15. The housing system as recited in claim 14, wherein said control housing comprises a circular cylindrical outer surface having an annular groove formed therein, said seal comprising an O-ring seated in said annular groove.

16. The housing system as recited in claim 12, wherein each of said inlet housing and said control housing is a cast metal or molded plastic structure.

17. A boat comprising:

a hull having an opening;

a duct mounted to said hull and comprising an inlet and an outlet;

an impeller rotatably supported within said duct;

a steering nozzle which is pivotably mounted to said duct;

a steering assembly for pivoting said steering nozzle, said steering assembly comprising a steering shaft, an upper steering subassembly for rotating said steering shaft, and a lower steering subassembly for coupling pivoting of said steering nozzle to rotation of said steering shaft; and a shaft housing comprising a first bore in which said steering shaft is rotatably mounted, wherein said shaft housing and said steering shaft penetrate said opening in said hull.

18. The boat as recited in claim 17, further comprising:

a pivotable reverse gate; and a shift assembly for pivoting said reverse gate, said shift assembly comprising a shift shaft, an upper shift subassembly for rotating said shift shaft, and a lower shift subassembly for coupling pivoting of said reverse gate to rotation of said shift shaft, wherein said shaft housing further comprises a second bore in which said shift shaft is rotatably mounted, wherein said shift shaft penetrates said opening in said hull.

19. A boat comprising:

a hull having an opening;

a duct mounted to said hull and comprising an inlet and an outlet;

an impeller rotatable supported within said duct:

a reverse gate which is pivotably mounted to said duct;

a shift assembly for pivoting said reverse gate, said shift assembly comprising a shift shaft, an upper shift subassembly for rotating said shift shaft, and a lower shift subassembly for coupling pivoting of said reverse gate to rotation of said shift shaft; and a shaft housing comprising a bore in which said shift shaft is rotatably mounted, wherein said shaft housing and said shift shaft penetrate an opening in said hull.

20. A cast housing comprising:

a generally planar base;

first and second upper structures extending from said base in a first direction generally perpendicular to said base, the maximum height of said first upper structure being greater than the maximum height of said second upper structure;

first and second lower structures extending from said base in a second direction generally opposite to said first direction;

a first bore passing through said first upper structure, said base and said first lower structure;

a second bore passing through said second upper structure, said base and said second lower structure, said second bore being parallel to said first bore and of different length; and a first arcuate wall extending in said second direction and connecting said first and second lower structures; and a second arcuate wall extending in said second direction and connecting said first and second lower structures, wherein said first and second lower structures and said first and second arcuate walls form a generally circular cylindrical lower outer periphery.

21. The cast housing as recited in claim 20, wherein said base comprises a plurality of throughholes located radially outward of said lower outer periphery.

22. The cast housing as recited in claim 20, wherein said lower outer periphery comprises an annular groove radially outward of said lower outer periphery.

23. The cast housing as recited in claim 20, wherein each of said first and second bores has an upper and a lower annular recess at opposing ends thereof.

24. A marine craft comprising:

a hull comprising a generally horizontal hull section with an opening therein;

an inlet housing of a water jet apparatus attached to said generally horizontal hull section and comprising a water tunnel located entirely below said generally horizontal hull section, and a cavity located outside the water tunnel and having a first opening facing and communicating with said opening in said generally horizontal hull section;

a shaft housing installed in said cavity of said inlet housing and comprising a first bore penetrating said opening in said generally horizontal hull section; and a first shaft rotatably supported in said first bore.

25. The marine craft as recited in claim 24, wherein said shaft housing further comprises a second bore penetrating said opening in said horizontal hull section, further comprising a second shaft rotatably supported in said second bore.

26. The marine craft as recited in claim 25, wherein said cavity in said inlet communicates with a space external to said inlet housing via second and third openings, further comprising a first lever having one end connected to an end of said first shaft and another end projecting into said external space, and a second lever having one end connected to an end of said second shaft and another end projecting into said external space, wherein said first and second levers pass through said second and third openings respectively.

27. The marine craft as recited in claim 24, further comprising a seal arranged in said cavity between said control housing and said inlet housing.

28. The marine craft as recited in claim 24; wherein each of said inlet housing and said control housing is a cast metal or molded plastic structure.

29. The marine craft as recited in claim 24, wherein said cavity in said inlet communicates with a space external to said inlet housing via a second opening, further comprising a lever having one end connected to an end of said first shaft and another end projecting into said external space, said lever passing through said second opening.

* * * * *

UNITED STATES PATENT AND TRADEMARK OFFICE

CERTIFICATE OF CORRECTION

PATENT NO. : 6,244,914 B1 
DATED : June 12, 2001
INVENTOR(S) : Michael W. Freitag, Paul E. Westhoff, Richard M. McChesney and James R. Jones It is certified that error appears in the above-identified patent and that said Letters Patent is hereby corrected as shown below:

Column 8, claim 1,
Line 6, delete the comma after the second occurrence of the word "said".

Column 9, claim 12,
Line 5, replace the word "housings" with -- housing --.

Column 10, claim 27,
Line 57, after the number "24" replace the semi-colon with a comma.

Signed and Sealed this

Eleventh Day of December, 2001

*Attest:*

Nicholas P. Godici

*Attesting Officer*

NICHOLAS P. GODICI
*Acting Director of the United States Patent and Trademark Office*